US006896060B2

(12) United States Patent
Tillett, Jr.

(10) Patent No.: US 6,896,060 B2
(45) Date of Patent: May 24, 2005

(54) DOWNHOLE JARRING TOOL ADJUSTER

(75) Inventor: Ray O. Tillett, Jr., Houma, LA (US)

(73) Assignee: Impact Selector, Inc., Rockwall, TX (US)

( * ) Notice: Subject to any disclaimer, the term of this patent is extended or adjusted under 35 U.S.C. 154(b) by 10 days.

(21) Appl. No.: 10/401,937

(22) Filed: Mar. 27, 2003

(65) Prior Publication Data

US 2004/0188085 A1 Sep. 30, 2004

(51) Int. Cl.[7] ..... E21B 31/107

(52) U.S. Cl. ..... 166/301; 166/178; 175/299; 175/306

(58) Field of Search ..... 166/178, 177.6, 166/177.7, 301; 175/299, 300, 306

(56) References Cited

U.S. PATENT DOCUMENTS 4,844,157 A * 7/1989 Taylor ..... 166/178
5,669,458 A * 9/1997 Anders ..... 175/299

* cited by examiner

*Primary Examiner*—Zakiya Walker
(74) *Attorney, Agent, or Firm*—Haynes and Boone, LLP

(57) ABSTRACT

A downhole jarring apparatus including a shaft and a first mandrel configured to releasably engage, a collar operatively attached to the shaft such that an axial position of the collar relative to the shaft is adjustable by access through an opening in an outer surface of a second mandrel, and an energy store configured to exert a force against the shaft, wherein the force is adjustable in response to the axial position of the collar relative to the shaft.

20 Claims, 2 Drawing Sheets

DOWNHOLE JARRING TOOL ADJUSTER

BACKGROUND OF THE INVENTION

The present invention relates to downhole fishing and drilling operations, or removing obstructions to a drilling line when such a line becomes lodged or otherwise stuck in a well bore. Consequences of failure to remove the obstruction can be failure of the well to produce at all or in part, also, current methods of removing obstructions can result in failure to loosen the work string, both of which result in having to relocate the drilling operation, which necessarily involves lost time and money.

This problem can be overcome, as it is now, by various devices which exert pressure or mechanical energy on the work string in an attempt to dislodge it. These tools are generally large, complex and expensive, and many are not easily configured to apply varying amounts of force to the work string, which can result in imprecise application of energy to the work string. This, in turn, can break or otherwise damage the work string, resulting in a requisite move of a project, or at the very least, lost time and energy in repairing the work string.

The current invention fills the existing gap in technology by providing a relatively small, simple, adjustable tool which can be easily transported and implemented and be tailored to specific applications.

It is known in the art to apply force to dislodge a work string, however the current devices in this field do not offer the unique combination of the small, simple and configurable characteristics inherent in the configuration presented herein.

OBJECTS OF THE INVENTION

One object of this invention is to provide a configurable device which can apply specific amounts of pressure to a work string.

Another object of the invention is to provide a device that is small and easily transported.

Still another object of the invention is to provide a device that is able to shield an adjustment mechanism with a sleeve.

Other objects and advantages of this invention shall become apparent from the ensuing descriptions of the invention.

SUMMARY OF THE INVENTION

According to the present invention, the invention is a downhole tool for manipulating a work string which is easily configured to deliver a specific amount of force to the work string in a small and simple apparatus.

BRIEF DESCRIPTION OF THE DRAWINGS

The accompanying drawings illustrate an embodiment of this invention. However, it is to be understood that this embodiment is intended to be neither exhaustive, nor limiting of the invention. They are but examples of some of the forms in which the invention may be practiced.

DETAILED DESCRIPTION OF EXEMPLARY EMBODIMENTS

Figure 1A:
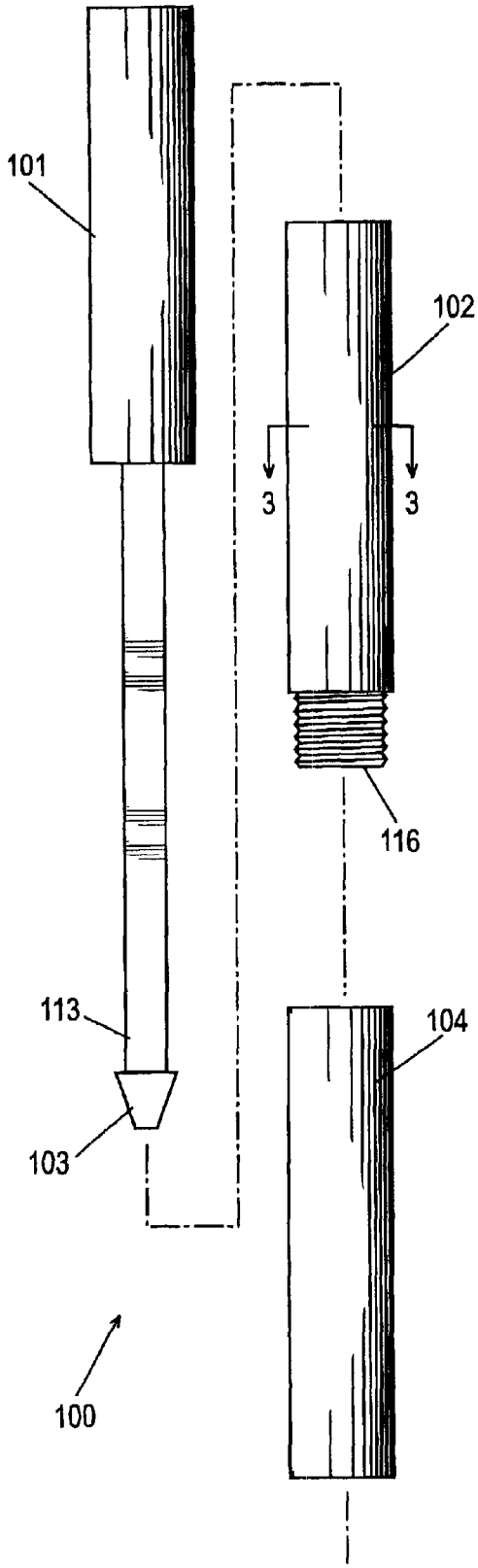
FIG. 1A shows a side view of the top half of the jarring tool, partially disassembled.
Figure 1B:
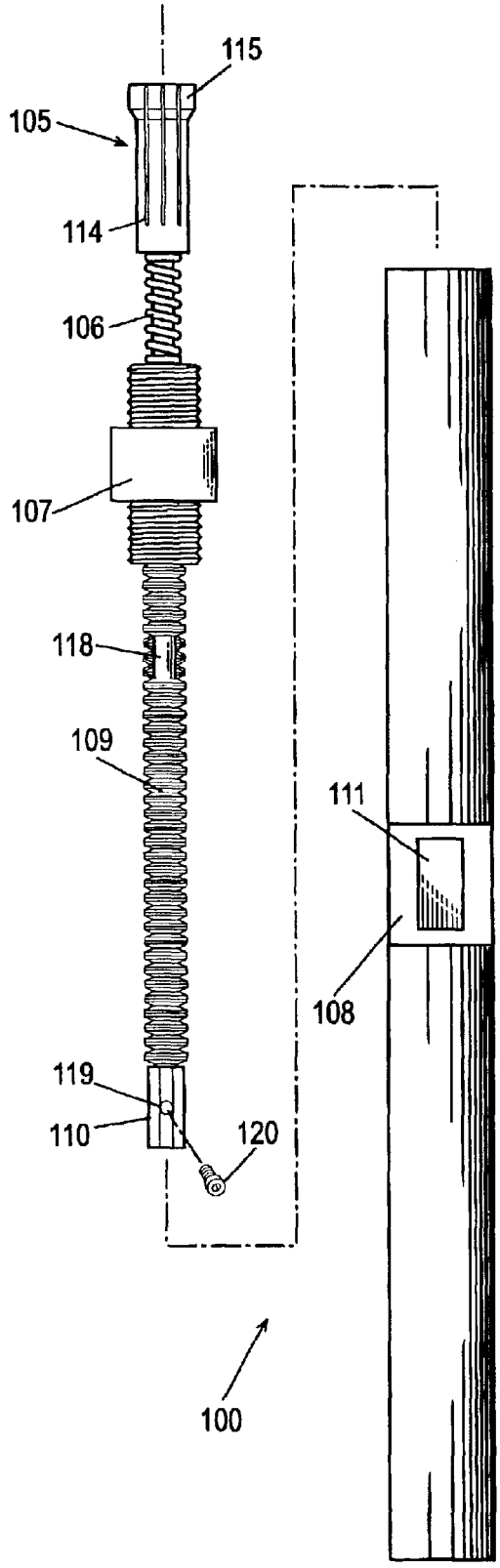
FIG. 1B shows a side view of the bottom half of the jarring tool, partially disassembled.
Figure 2A:
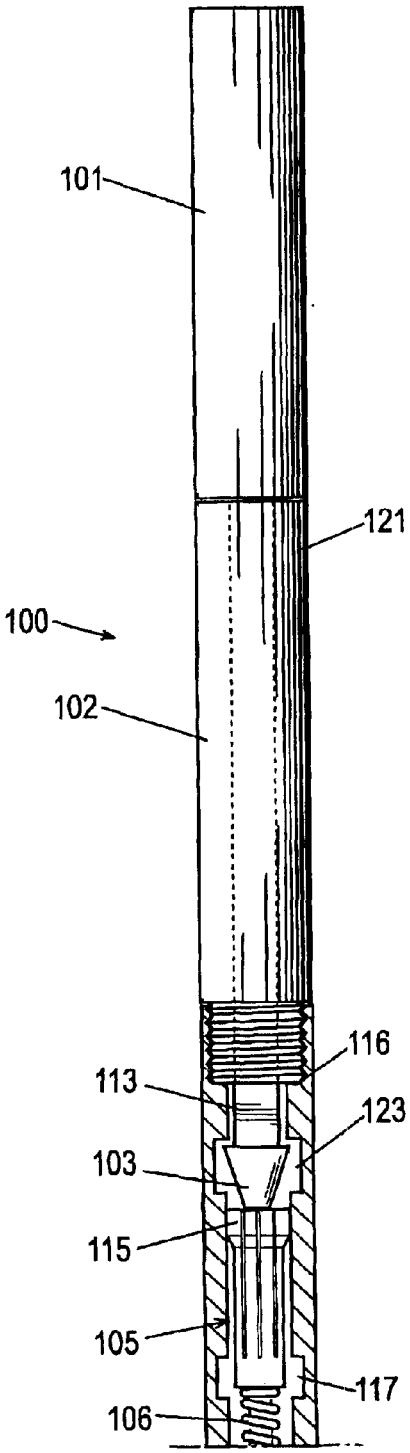
FIG. 2A shows a cutaway view of the top half of the jarring tool.
Figure 3:
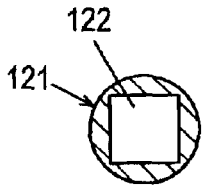
FIG. 3 shows a top view of the aligning collar.
Figure 2B:
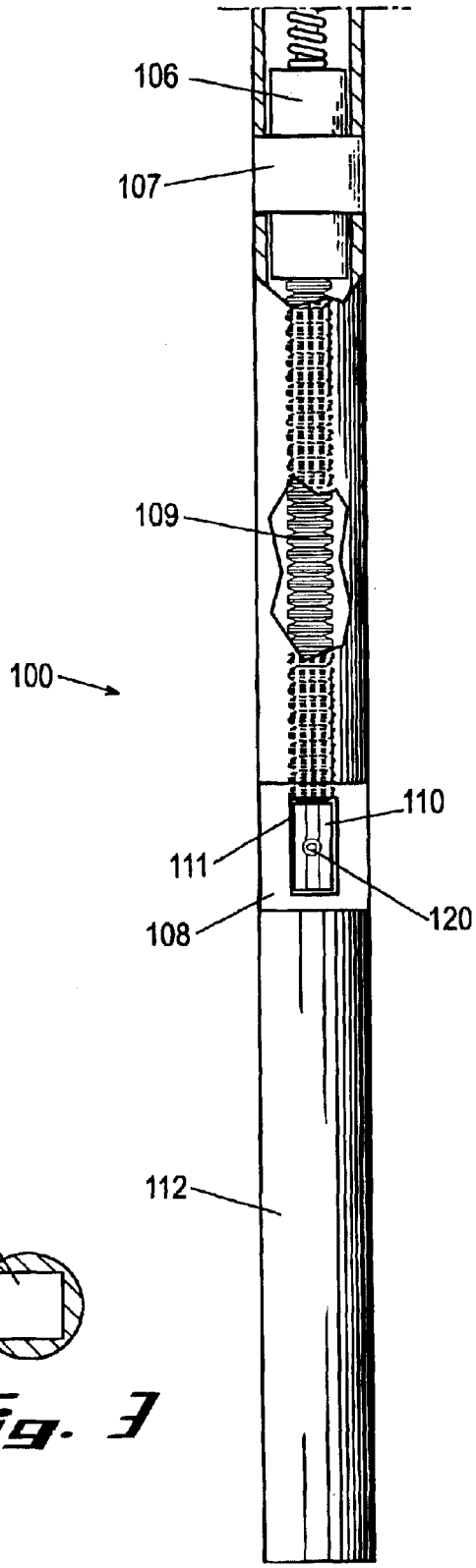
FIG. 2B shows a cutaway view of the bottom half of the jarring tool.

Without any intent to limit the scope of this invention, reference is made to the figures in describing the various embodiments of the invention. Referring to FIGS. 1 through 3, line downhole jarring tool 100 is pictured.

Jarring tool 100 has a hammer mandrel 101 near the top end of jarring tool 100 which is formed with shaft 113 extending from the bottom end of hammer mandrel 101. Shaft 113 can be formed such that a portion of shaft 113 has beveled sides, providing a flat surface that permits the shaft to be turned with a wrench, as well as forming a "keyed" relationship with the square opening 122 of retaining mandrel 102's aligning collar 121. This "keyed" relationship prevents relational torquing between shaft 113 and retaining mandrel 102. This arrangement also precludes the need for aligning screws or other components, which detract from the simplicity and effectiveness of a tool.

At the end of shaft 113, shaft 113 forms a releasable bolt 103 which can be shaped conically as pictured, but could conceivably take various shapes, so long as releasable bolt 103 could be grasped and retained by another device, as explained in further detail below. The conical or "spear" shape of releasable bolt 103 also facilitates the re-entry of releasable bolt 103 into collet 105, explained in greater detail below.

Retaining mandrel 102 surrounds shaft 113, and is usually threaded at one end to receive firing mandrel 104 which lies below it on jarring tool 100. Firing mandrel 104 is generally cylindrical in shape, and having unlatching recess 117 along firing mandrel's 104 inner diameter, which is shaped to accommodate collet 105 as outlined below. Releasable bolt 103 also prevents shaft 113 from disengaging retaining mandrel 102 by virtue of releasable bolt's 103 size being larger than that of the edge 116 of retaining mandrel 102.

Collet 105 is attached to a kinetic energy shaft 118 toward the top end of jarring tool 100. Collet 105 can have longitudinal slits 114 around its body, such that the overall diameter of collet 105 can be permitted to increase by radially expanding or separating slits 114. The top end 115 of collet 105 should also be configured to be of larger diameter than the remainder of collet 105 to create a section that can enter either latching recess 117 or unlatching recess 123 of firing mandrel 104 permitting collet 105 to expand. This will be explained in greater detail below.

Positioned between collet 105 and middle joint 107 is reloading mechanism 106, generally a spring or spring-type device, which is held in place between collet 105 and middle joint 107. It is positioned such that pressure is exerted upwardly on collet 105 and downwardly on middle joint 107.

Kinetic energy store 109 is positioned around kinetic energy shaft 118, and can be any mechanical kinetic energy store, like a Belleville washer stack or a spring. Kinetic energy store 109 is usually a Belleville washer stack, which is generally an assemblage of concave washers stacked end to end such that resistance and linear energy is built up when the kinetic energy store 109 is compressed.

At the base of kinetic energy shaft 118 is threaded or otherwise attached adjuster collar 110. This is configured such that as adjuster collar 110 is threaded onto the bottom end of kinetic energy shaft 118, such that as adjuster collar 110 is turned up the tool, compression is naturally increased on the kinetic energy store 109, and thus upward resistance is increased.

There is also in some exemplary forms of the invention threaded hole 119 drilled in kinetic energy shaft 118, generally perpendicular to the lateral axis of jarring tool 100. This provides for setscrew 120 which, when engaged in threaded hole 119, prevents adjuster collar 110 from turning about its axis.

Surrounding and encasing kinetic energy shaft 118 and kinetic energy store 109 is bottom mandrel 112. Integrated in bottom mandrel 112 is adjuster collar guard 108. Collar guard 108 has opening 111 which is essentially a window used to access adjuster collar 110. Collar guard 108 is able to be turned about the axis of the tool, such that opening 111 only reveals a small portion of the surface beneath it. When properly actuated, however, opening 111 of collar guard 108 reveals adjuster collar 110 so that it may be accessed, and thus adjusted via various means. If collar guard 108 is then turned further, it effectively conceals adjuster collar 108, thus preventing contaminants from entering, or from accidental adjustment of the components.

Joining bottom mandrel 112 to firing mandrel 104 is middle joint 107, which also houses a portion of kinetic energy shaft 118.

Each of the parts which lie along the central axis, if they are to be used in an application which requires electrical, data or other connections at the base of the tool can have a bore drilled parallel to this axis to permit runs of electrical or other wire through the center of jarring tool 100. In such an application, parts along the center portion of the tool, such as shaft 113, releasable bolt 103, hammer mandrel 101, collet 105 and kinetic energy shaft 118 have a bore in the center of them, permitting a wire or other ductile compound to be threaded through them, and thus, the entire tool.

In operation, line downhole jarring tool 100 will be attached on its top and bottom ends to the work string. Jarring tool 100 will be likely initially "set," whereby releasable bolt 103 is inserted into the center of collet 105. This "setting" procedure is accomplished by moving shaft 113, and thus bolt 103, toward the bottom end of jarring tool 100. Bolt will press against collet 105, pushing it down whereby the top 115 of collet 105 will enter latching recess 117, and bolt 103 will enter collet 105. In this way, bolt 103 becomes mechanically coupled with collet 105, and is ready for the impact stroke of jarring tool 100.

Adjuster collar guard 108 will be rotated about the axis of jarring tool 100 so that opening 111 will permit access to setscrew 120, such that setscrew 120 may be removed, in turn permitting adjuster collar 110 to be threaded up or down, providing a corresponding increase or decrease in the tension stored in kinetic energy store 109. In an exemplary embodiment, each full turn of adjuster collar 110 will raise or lower the pressure stored in kinetic energy store 109 by one hundred (100) pounds. Setscrew 120 can then be replaced, effectively locking adjuster collar 110 in place. Adjuster collar guard 108 can then be rotated back around to re-conceal setscrew 120 and related parts of adjuster collar 110. Naturally, the setting need not be one hundred pounds, but is helpful to the operator to be in whole number increments, as to provide easy administration of pressure changes.

When an obstruction is encountered, or the drill string otherwise needs to be loosened, force will be applied to jarring tool 100, drawing back on the end of jarring tool 100. When this force is applied to hammer mandrel 101, shaft 113 is also drawn upward by virtue of its mechanical connection to hammer mandrel 101. Releasable bolt 103 will similarly be drawn back, and move with it collet 105 and thus kinetic energy shaft 118.

As the force is applied, kinetic energy will continue to build as a result of the compression of kinetic energy store 109 under the force applied to hammer mandrel 101. As this force increases, hammer mandrel 101, shaft 113, releasable bolt 103, collet 105, and kinetic energy shaft 118 all move toward the top end of jarring tool 100 until collet's 105 top end 115 slides into unlatching recess 117, at which point longitudinal slits 114 expand, and releasable bolt 103 is released.

As a result of this, the full store of kinetic energy in kinetic energy store 109 is exerted up and away, such that releasable bolt 103 travels quickly up within retaining mandrel 102 until it strikes edge 116 of retaining mandrel 102, delivering the upward stroke, which, by design, helps to loosen the work string.

At this time, the previous force exerted upon tool should be reversed, mechanically or otherwise, such that releasable bolt 103 will be inserted back into collet 105. As bolt 103 is inserted into collet 105, collet 105 is pushed back beyond unlatching recess 117 such that slits 114 are compressed, once again holding and retaining releasable bolt 103 within the confines of collet 105. This cycle is thus repeated to achieve the desired hammering effect to loosen or otherwise manipulate the work string.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

The invention claimed is:

1. A downhole jarring apparatus, comprising:

a first mandrel;

a shaft, wherein the shaft and the first mandrel are configured to releasably engage;

a second mandrel;

a collar operatively attached to the shaft, wherein an axial position of the collar relative to the shaft is adjustable by access through an opening in an outer surface of the second mandrel; and an energy store configured to exert a force against the shaft, wherein the force is adjustable in response to the axial position of the collar relative to the shaft.

2. The downhole jarring apparatus of claim 1 wherein the collar is operatively attached to the shaft by threaded engagement such that the axial position of the collar relative to the shaft is adjustable in response to rotation of the collar relative to the shaft via access of the collar through the opening in the outer surface of the second mandrel.

3. The downhole jarring apparatus of claim 1 wherein the outer surface of the second mandrel is substantially cylindrical.

4. The downhole jarring apparatus of claim 1 wherein the axial position of the collar relative to the shaft is adjustable by access through the opening in the outer surface of the second mandrel without disassembling any of the downhole jarring apparatus.

5. The downhole jarring apparatus of claim 1 wherein the energy store comprises a compressible element selected from the group consisting of:

a plurality of compressible washers;

a plurality of Belleville washers; and a spring.

6. The downhole jarring apparatus of claim 1 wherein a first end of the energy store is substantially fixed relative to the second mandrel and a second end of the energy store is substantially fixed relative to the collar.

7. The downhole jarring apparatus of claim 1 wherein the first mandrel includes a hammer mandrel and an extension extending from the hammer mandrel, wherein a first shape of a first end of the extension and a second shape of a second end of the shaft cooperate to releasably couple therewith.

8. The downhole jarring apparatus of claim 7 wherein the first shape is substantially conical.

9. The downhole jarring apparatus of claim 1 wherein the shaft includes a collet having a radially expandable end configured to cooperate with the first mandrel to releasably couple therewith.

10. The downhole jarring apparatus of claim 9 wherein at least a portion of an internal profile limits expansion of the radially expandable end of the collet, wherein the internal profile includes:

a first recess configured to allow sufficient expansion of the radially expandable end of the collet to allow the first mandrel and the shaft to at least temporarily detach; and a second recess configured to allow sufficient expansion of the radially expandable end of the collet to allow the first mandrel and the shaft to at least temporarily attach.

11. The downhole jarring apparatus of claim 10 wherein the second mandrel includes a third mandrel having the internal profile and the first and second recesses.

12. The downhole jarring apparatus of claim 1 further comprising a setscrew configured to limit rotation of the collar relative to the shaft.

13. The downhole jarring apparatus of claim 1 further comprising a collar guard having a guard opening, wherein the collar guard is rotatable around an axis of the second mandrel to selectively conceal the opening in the outer surface of the second mandrel and reveal the second mandrel outer surface opening through the guard opening.

14. The downhole jarring apparatus of claim 13 further comprising a setscrew configured to limit rotation of the collar guard relative to the second mandrel.

15. The downhole jarring apparatus of claim 1 wherein an inner profile that is rotationally fixed relative to the second mandrel includes a first cross-sectional shape configured to cooperate with a second cross-sectional shape of at least a portion of the first mandrel to limit rotation of the first mandrel relative to the second mandrel.

16. The downhole jarring apparatus of claim 1 further comprising a work string coupled at least indirectly to at least one of the first and second mandrels.

17. A method, comprising:

attaching a downhole jarring apparatus to a work string, the downhole jarring apparatus including:

a shaft and a first mandrel configured to releasably engage;

a collar operatively attached to the shaft, wherein an axial position of the collar relative to the shaft is adjustable by access through an opening in an outer surface of a second mandrel; and an energy store configured to exert a force against the shaft, wherein the force is adjustable in response to the axial position of the collar relative to the shaft;

engaging the shaft and the first mandrel if the shaft and the first mandrel are disengaged;

adjusting the force exerted by the energy store against the shaft by accessing the collar through the opening to adjust the axial position of the collar relative to the shaft; and increasing a work string force applied by the work string to the downhole jarring apparatus until the shaft and the first mandrel disengage.

18. The method of claim 17 wherein adjusting the force exerted by the energy store includes rotating the collar to adjust the axial position of the collar relative to the shaft.

19. The method of claim 18 wherein accessing the collar through the opening includes temporarily loosening a setscrew configured to limit rotation of the collar relative to the shaft.

20. The method of claim 17 wherein accessing the collar through the opening includes rotating a collar guard having a guard opening to temporarily reveal the second mandrel outer surface opening through the guard opening.

* * * * *